US005211249A

United States Patent [19]

Richter et al.

[11] Patent Number: 5,211,249

[45] Date of Patent: May 18, 1993

[54] APPARATUS AND METHOD FOR OBTAINING SUBTERRANEAN SAMPLES

[75] Inventors: David L. Richter; Michael C. Kasl; David Overman; Joel F. Wilson, all of Ponca City, Okla.

[73] Assignee: Conoco Inc., Ponca City, Okla.

[21] Appl. No.: 831,223

[22] Filed: Jan. 31, 1992

[51] Int. Cl.[5] ..... E21B 25/10; E21B 49/02

[52] U.S. Cl. ..... 175/20; 175/58; 175/249

[58] Field of Search ..... 166/99, 301; 175/20, 175/21, 23, 58, 249

[56] References Cited

U.S. PATENT DOCUMENTS

| | | | |
|---|---|---|---|
| 2,382,992 | 8/1945 | Harris | 175/20 |
| 2,403,002 | 7/1946 | Johnson | 175/249 X |
| 2,664,269 | 12/1953 | Knight et al. | 175/20 |
| 2,751,010 | 6/1956 | Trahan | 175/249 X |
| 3,075,588 | 1/1963 | Mitchell | 175/20 |
| 3,367,188 | 2/1968 | Robinson | 175/20 |
| 3,952,817 | 4/1976 | Anderson | 175/249 |
| 4,059,155 | 11/1977 | Greer | 166/99 X |

*Primary Examiner*—Stephen J. Novosad

[57] ABSTRACT

The present invention provides an apparatus and method for obtaining a subterranean material sample. The inventive sampling apparatus comprises an elongate housing having a passageway extending longitudinally therethrough, a tip member movable through the passageway, and a locking means for releasably preventing the tip member from moving from a first portion of the passageway to a second portion of the passageway. The inventive sampling method comprises the step of inserting the inventive sampling apparatus into the ground. The present invention also provides a device for retaining material in a housing, said device comprising a plurality of resilient petal members.

27 Claims, 3 Drawing Sheets

APPARATUS AND METHOD FOR OBTAINING SUBTERRANEAN SAMPLES

FIELD OF THE INVENTION

In one aspect, the present invention relates to devices for obtaining subterranean material samples. In another aspect, the present invention relates to devices for retaining subterranean material samples in sampler housings. In yet another aspect, the present invention relates to methods for obtaining subterranean material samples.

BACKGROUND OF THE INVENTION

Cone penetrometer systems are commonly used for analyzing subterranean materials and conditions and for developing stratigraphic maps. Recently, cone penetrometer systems have been used in addressing underground contamination problems. Through subsurface analysis, sample recovery, and mapping, cone penetrometer systems have been used to determine the existence and nature of underground contamination problems and to evaluate possible solutions.

A cone penetrometer system will typically utilize a long tubing string having a sensing tool, a sampling tool, and/or some other type of tool positioned on the end thereof. The tubing string is preferably driven, without drilling or turning, into the ground using a hydraulic ram. In some applications, the tubing string is driven 300 or more feet into the ground. For convenience, the hydraulic ram is typically included on a cone penetrometer truck.

In conducting a cone penetrometer test, a relatively small diameter tubing string having a cone on the end thereof is typically driven into the ground first. The cone can be equipped with electronic sensors which take seismic readings and measure such parameters as: the frictional forces encountered by the tubing string; pore water pressure; temperature; inclination; and resistivity. This data is processed and interpreted to obtain a complete stratigraphic map of the test site. Once the stratigraphic data is obtained, the small diameter tubing string is typically pulled out of the ground.

Next, a tubing string having a sample retrieving tool positioned on the end thereof is typically driven into the ground. Sample retrieving tools can be used to obtain underground soil and/or water samples from any particular zone of interest.

The soil sampling tool used heretofore is composed generally of: a sample barrel for collecting the sample material; a rod having one end attached to the end of the penetrometer tubing string; and a tapered driving tip attached to the other end of said rod. As the soil sampling tool is driven into the ground, the rod extends through the sample barrel such that the base end of the sample barrel abuts the end of the tubing string and the driving tip projects from, and blocks, the forward end of the sample barrel. The outside diameter of the base of the driving tip is slightly smaller than the inside diameter of the sample barrel so that the driving tip can be retracted from the forward end of the sample barrel to the base of the sample barrel.

When the soil sampling tool reaches a desired underground sampling location, the penetrometer tubing string is pulled from the ground a sufficient distance to retract the driving tip from the forward end of the sample barrel to the base end of the sample barrel. As the tubing string is being pulled from the ground in order to retract the driving tip, the sample barrel is held at a fixed position in the ground by soil which has compacted around the sample barrel as a result of the driving operation. When the driving tip reaches the base end of the sample barrel, the driving tip and rod automatically lock in place so that the rod can be used to push the sample barrel, which is now open to receive the underground material sample, deeper into the formation. As the sample barrel is pushed deeper into the formation, soil is forced into the forward end of the sample barrel. After the sample barrel has been filled with sample material, the sample barrel is pulled from the ground.

The above-described soil sampling tool is designed primarily for use in stratigraphic analysis rather than environmental analysis. Specifically, the tool is designed primarily to allow the recovery and visual classification of underground soil samples.

The above-described soil sampling tool has numerous shortcomings, particularly when used for collecting samples for environmental analysis. For example, the tool's driving tip does not completely seal the forward end of the sample chamber; consequently, material, e.g., water and/or soil, from other formations enters and contaminates the sample chamber as the sampling tool is driven into the ground. Additionally, since the forward end of the sample barrel must remain open after the sample is taken, unconsolidated sample material can simply fall out of the forward end of the sample barrel as the sample barrel is pulled from the ground. Further, the sample barrel does not hold a sufficient quantity of sample material for the performance of a complete environmental analysis. In order to obtain a quantity of sample material sufficient for a complete environmental analysis, the sampling tool must be driven into and withdrawn from the ground numerous times.

Previous attempts to increase the size of the sample barrel have been largely unsuccessful. Substantially increasing the size of the sample barrel greatly increases the amount of stress encountered by the rod member when said rod member is used to drive the sample chamber deeper into the ground. Further, any increase in the length of the sample chamber must be matched by a corresponding increase in the length of the rod member. However, it has been found that any substantial increase in rod member length greatly increases the risk of rod member breakage.

In addition to the above, it has not been possible heretofore to obtain a continuous core sample using a cone penetrometer system. As indicated, any significant increase in sample chamber length must be matched by a corresponding increase in rod member length. Thus, increasing the length of the sample chamber renders the rod member extremely vulnerable to breakage. Consequently, the collection of a continuous core sample from a depth exceeding about 10 feet has heretofore required the use of a drilling system.

SUMMARY OF THE INVENTION

The present invention provides an apparatus and a method for obtaining a subterranean material sample. The inventive method comprises the step of inserting the inventive apparatus into the ground. The inventive apparatus comprises: an elongate housing having a passageway extending longitudinally therethrough; a tip member; and a locking means. The elongate housing has a first end and a second end. The passageway extending through the housing has a first portion and a second portion, said first portion being closer than said second portion to the first end of the elongate housing. The tip member is positionable in the second portion of the passageway such that the tip member protrudes from the second end of the housing. The tip member is movable in the passageway from the second portion of the passageway to the first portion of the passageway. The locking means releasably prevents the tip member from moving from the second portion of the passageway to the first portion of the passageway. The inventive apparatus preferably further comprises a sealing means, associatable with the tip member, for sealing the passageway when the tip member is positioned in the second portion of the passageway.

The present invention also provides a device for retaining material in a housing. The device comprises a plurality of resilient petal members which will open to allow the material to pass therethrough into the housing. However, the petal members will resiliently close to prevent the sample material from passing therethrough out of the housing.

In contrast to the soil sampling tools and methods used heretofore, the present invention allows the in-depth collection of a continuous core sample using a cone penetrometer system. Using only a single insertion of the inventive apparatus, a sufficient quantity of sample material can be obtained from a given underground location for the performance of a complete environmental analysis. Additionally, the passageway extending through the housing of the inventive apparatus is sealed as the inventive apparatus is driven into the ground; consequently, the present invention substantially eliminates the abovedescribed contamination problems. Further, the present invention provides means for preventing sample material from falling out of the inventive apparatus as the apparatus is withdrawn from the ground.

Further objects, features, and advantage of the present invention will be readily apparent to those skilled in the art upon reference to the accompanying drawings and upon reading the following description of the preferred embodiments.

DESCRIPTION OF THE PREFERRED EMBODIMENTS

Figure 2:
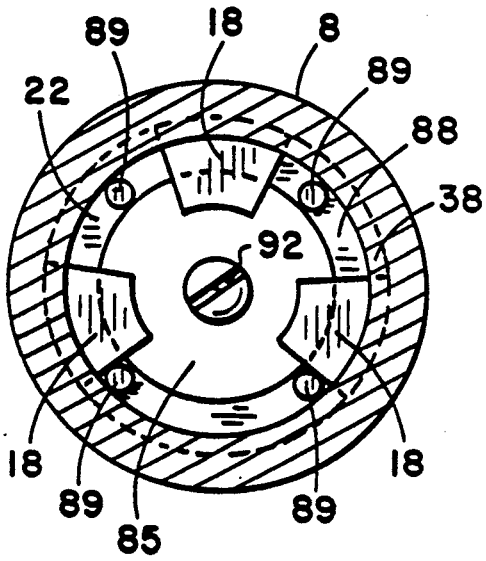
FIG. 2 provides a top cutaway view of the inventive sampling apparatus taken along line 2—2 depicted in FIG. 1.
Figure 1:
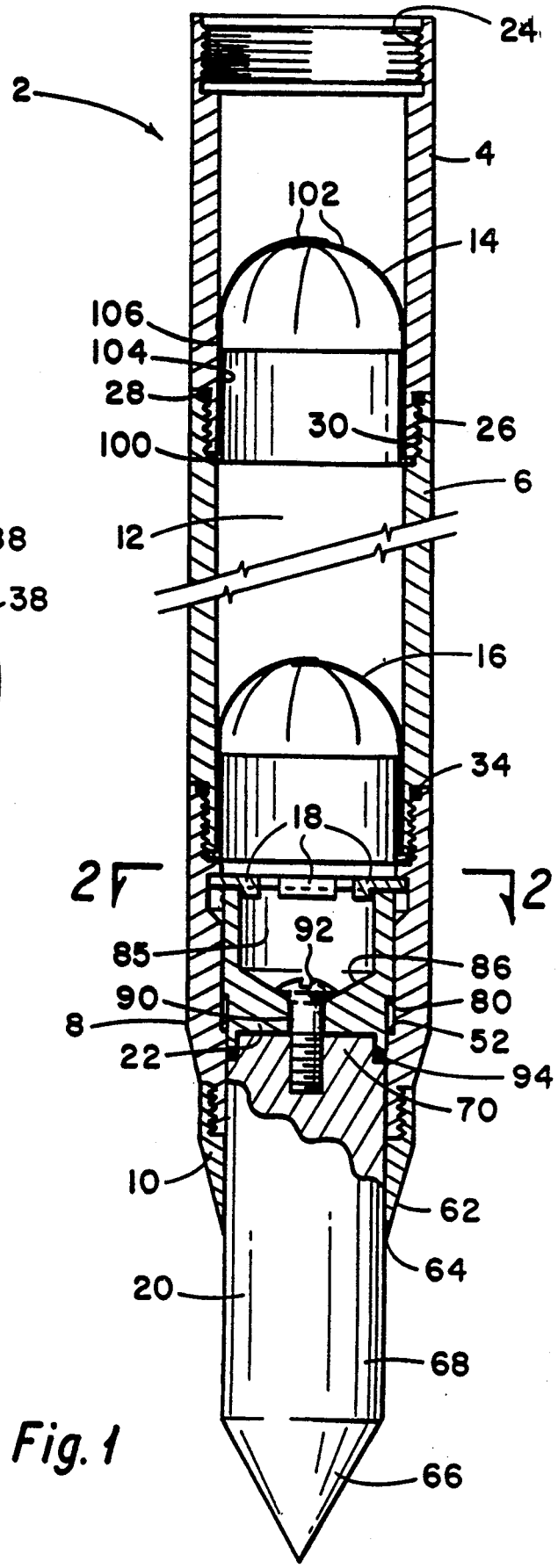
FIG. 1 provides a cutaway side view of an embodiment of the sampling apparatus of the present invention.
Figure 3:
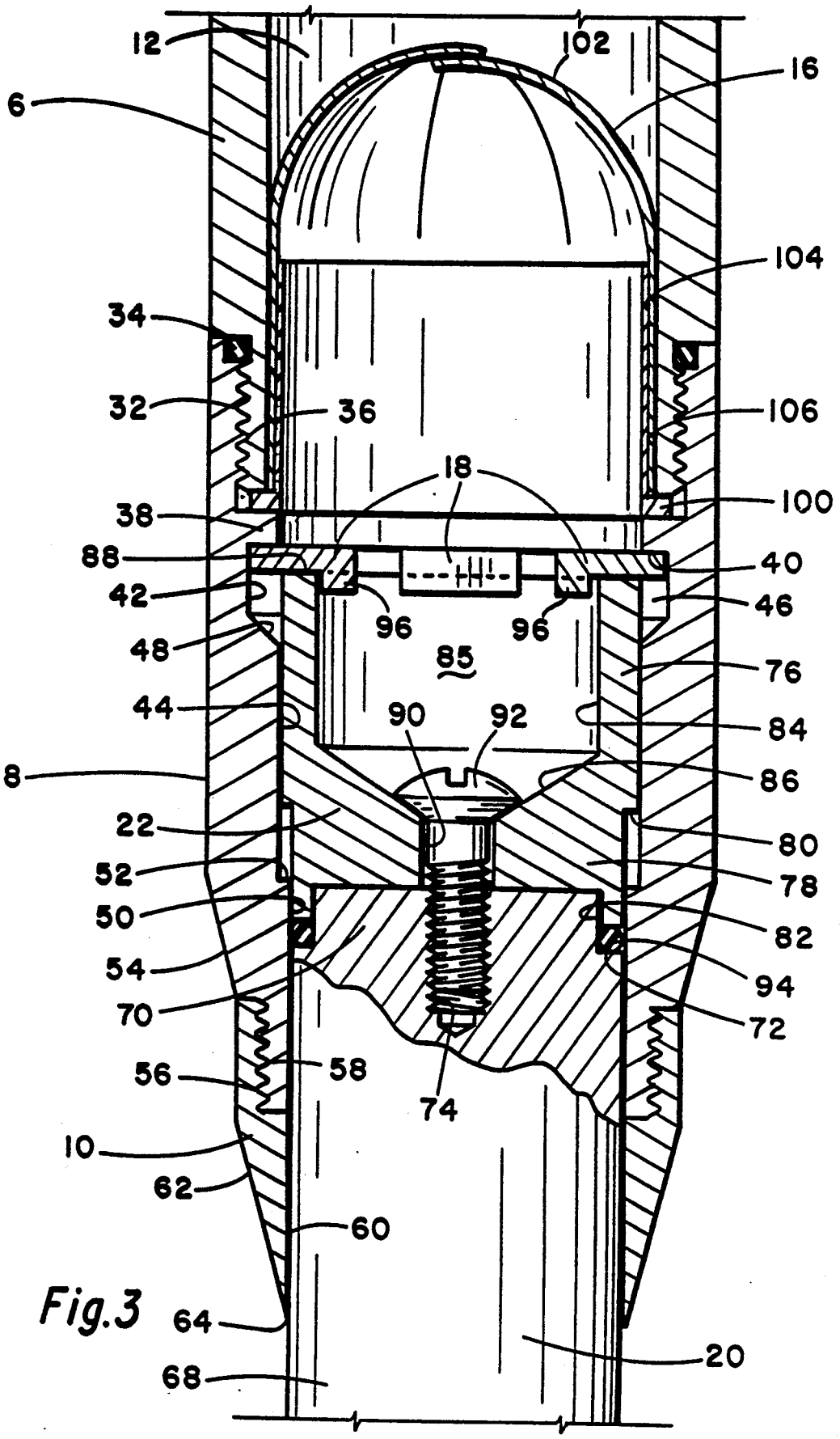
FIG. 3 provides an enlarged side view of a portion of the sampling apparatus depicted in FIG. 1.

Depicted in FIGS. 1–3 is an embodiment of the sampling apparatus 2 of the present invention. Apparatus 2 comprises: an adapter 4; one or more sample tubes 6; a tip holder 8; and a cutting member 10. Adapter 4, sample tube(s) 6, tip holder 8, and cutting member 10 define a housing having a passageway 12 extending longitudinally therethrough. Apparatus 2 further comprises a tip retainer 14, a sample holder 16, locking keys 18, a tip member 20, and a tip locking member 22.

As depicted in FIG. 1, adapter 4 is a tubular member having an internally threaded portion 24 at one end thereof for connecting apparatus 2 to the end of a penetrometer tubing string. Adapter 4 has an externally threaded portion 26 at the other end thereof for connecting adapter 4 to a sample tube 6. O-ring 28 is positioned at the base of externally threaded portion 26 for sealing the connection between adapter 4 and sample tube 6. As will be apparent to those skilled in the art, the internal and external diameters of the various portions of adapter 4 can be varied as necessary for connecting apparatus 2 to penetrometer tubing strings having outside diameters which are smaller than, larger than, or equivalent to the outside diameter of sample tube(s) 6.

Each sample tube 6 is a tubular member having an internally threaded portion 30 at one end thereof and an externally threaded portion 32 at the other end thereof. Each sample tube preferably has a length in the range of from about 12 to about 13 inches. Depending upon the amount of sample and/or the length of sample core desired, any number of serially connected sample tubes 6 can be included in apparatus 2. The internally threaded portion 30 of the first sample tube 6 is connected to the externally threaded portion 26 of adapter 4. The externally threaded portion 32 of the last sample tube 6 is connected to tip holder 8. An O-ring 34 is positioned at the base of each externally threaded portion 32 in order to seal the connection between the serially connected sample tubes 6 and between the last sample tube 6 and tip holder 8.

Tip holder 8 comprises: an internally threaded portion 36 for connecting tip holder 8 to the last sample tube 6; an annular interior lip 38, adjacent internally threaded portion 36, having an abutment surface 40; a cylindrical interior bore portion 42 adjacent lip 38; a cylindrical interior bore portion 44 having an internal diameter less than that of bore portion 42; an interior bore portion 46 extending from cylindrical bore portion 42 to cylindrical bore portion 44, said bore portion 46 defining a frusto-conical interior surface 48; a cylindrical interior bore portion 50 adjacent bore portion 44 and having an interior diameter less than that of bore portion 44; and a shoulder 52 defined by the transition from bore portion 44 to bore portion 50. Tip holder 8 further comprises a frusto-conical exterior surface 54, for facilitating the insertion of apparatus 2 into the ground, and an externally threaded portion 56 for connecting tip holder 8 to cutting member 10.

Cutting member 10 comprises: an internally threaded portion 58 for connecting cutting member 10 to tip holder 8; a cylindrical interior bore portion 60, adjacent portion 58, having an internal diameter substantially equivalent to the internal diameter of bore portion 50 of tip holder 8; a frusto-conical exterior surface 62; and a circular cutting edge 64 defined by the intersection of frusto-conical exterior surface 62 with the interior surface of bore portion 60.

Tip member 20 comprises a conically-shaped driving tip 66; a cylindrical portion 68, adjacent the base of conically-shaped driving tip 66, having an outside diameter equivalent to the outside diameter of the base of tip 66; a cylindrical end 70, adjacent cylindrical portion 68, having an outside diameter less than the outside diameter of cylindrical portion 68; and a shoulder 72 defined by the transition from cylindrical end 70 to cylindrical portion 68. A threaded bore 74 is provided in cylindrical end 70 of tip member 20 for connecting tip member 20 to tip locking member 22.

Tip locking member 22 comprises a first cylindrical portion 76 and a second cylindrical portion 78. First cylindrical portion 76 has a larger exterior diameter than second cylindrical portion 78. The exterior diameter of second cylindrical portion 78 is substantially equivalent to the exterior diameter of cylindrical portion 68 of tip member 20. A shoulder 80 is defined by the transition between cylindrical portion 76 and cylindrical portion 78. A cylindrical bore 82 is provided in the end of second cylindrical portion 78. The inside diameter of cylindrical bore 82 is slightly greater than the exterior diameter of cylindrical end 70 of tip member 20 so that cylindrical end 70 can be received within cylindrical bore 82. The end of first cylindrical portion 76 is provided with a cylindrical bore portion 84 and a frusto-conical bore portion 86. Bore portion 84, and bore portion 86 define a recess 85 in the end of tip locking member 22 for receiving keys 18 when apparatus 2 is unlocked. Cylindrical bore portion 84 defines a rim 88 on the end of cylindrical portion 76 on which keys 18 are positioned when apparatus 2 is locked. A bore 90 runs longitudinally through tip locking member 22 and is provided for connecting tip locking member 22 to tip member 20 using bolt 92.

An O-ring 94 is positioned between tip member 20 and tip locking member 22 as shown in FIGS. 1 and 3. O-ring 94 is compressed between tip member 20 and tip locking member 22 as tip member 20 is driven into the ground. O-ring 94 is preferably sized such that, during the driving operation, O-ring 94 is urged snugly against the interior surface of cylindrical bore portion 50 of tip holder 8 and thereby effectively seals passageway 12.

As shown in FIGS. 1-3, keys 18 are preferably pie-shaped pieces which are positionable between abutment surface 40 and rim 88. Each key preferably has a lip portion 96 which extends partially into recess 85 when keys 18 are positioned on rim 88. Apparatus 2 utilizes at least one key 18. Apparatus 2 preferably utilizes at least two keys 18. Apparatus 2 most preferably utilizes three keys 18 as shown in FIG. 2. Projections 89 are preferably provided on rim 88 for positioning and spacing keys 18 on rim 88 and for limiting the radial movement of keys 18.

As is apparent in FIGS. 1-3, the clearances (a) between annular lip 38 and the cylindrical portion 76 of tip locking member 22 and (b) between cylindrical portion 76 and the remaining portions of tip holder 8 below annular lip 38 are insufficient to allow locking keys 18 to fall to the outside of cylindrical portion 76. Consequently, when keys 18 are positioned as shown in FIGS. 1-3 and tip locking member 22 is urged upward in tip holder 8 (i.e., toward adapter 4), keys 18 are caught between rim 88 and lip 38 such that rim 88 binds against keys 18 and tip locking member 22 is thus prevented from moving through lip 38. However, when tip locking member 22 is lowered in tip holder 8 (i.e., when shoulder 80 of tip locking member 22 is moved toward shoulder 52 of tip holder 8), the outside ends of keys 18 contact frusto-conical surface 48 and are pushed by surface 48 into recess 85. With keys 18 thus positioned in recess 85, tip locking member 22 can subsequently move freely through annular lip 38.

Sample holder 16 is illustrated in FIGS. 1 and 3-5. Sample holder 16 comprises: a cylindrical portion 98; an outwardly extending lip 100 at the base of cylindrical portion 98; and a plurality of resilient petal members 102 extending upwardly and inwardly from the other end of cylindrical portion 98. The outside diameter of cylindrical portion 98 is slightly less than the inside diameter of sample tube(s) 6 so that sample holder 16 can be received within the male threaded end of sample tube 6. Sample holder 16 is held in place in apparatus 2 by lip 100 which is positionable between the male end of sample tube 6 and the female end of tip holder 8 in the manner shown in FIGS. 1 and 3.

Sample holder 16 can be formed, for example, by: (1) fabricating a thin-walled, cylindrical, 304 stainless steel member 104 having a lip 100 at the base thereof; (2) cutting a petal pattern 106 from a thin sheet of beryllium copper spring flex material, said pattern 106 having a rectangular portion and a plurality of petals 102 extending from one long side of the rectangular portion; (3) wrapping the rectangular portion of petal pattern 106 around the outside of cylindrical ring member 104; (4) attaching the rectangular portion of petal pattern 106 to ring member 104 by resistance welding; (5) bending petals 102 inwardly to the positions shown in FIGS. 4 and 5; (6) heat treating the sample holder 16 at about 600° F. for about one hour; and then (7) air quenching the sample holder.

Resilient petal members 102 of sample holder 16 flex open to allow tip locking member 22, tip member 20, and underground soil sample material to pass therethrough into sample tube(s) 6. Once the sample material passes therethrough, petal members 102 resiliently close and thereby prevent the sample material from falling out of sample tube(s) 6.

Tip retainer 14 used in apparatus 2 is identical to sample holder 16. Tip retainer 14 is positioned inside the male end of adapter 4. The lip 100 of tip retainer 14 is positioned between the male end of adapter 2 and the female end of sample tube 6. As sample tubes 6 are filled with sample material, tip locking member 22 and tip member 20 are forced through tip retainer 14. The petal members of tip retainer 14 flex open to allow tip locking member 22 and tip member 20 to pass into the interior of adapter 4. After tip member 20 passes into adapter 4, the petals of tip retainer 14 resiliently close to prevent tip locking member 22 and tip member 20 from falling back into sample tubes 6.

As is apparent, the outside diameters of all portions of tip locking member 22 and tip member 20 are sufficiently small to allow tip locking member 22 and tip member 20 to pass through passageway 12 from tip holder 8 to adapter 4. Tip locking member 22 and tip member 20 are prevented from falling out of the cutting end of apparatus 2 by the abutment of tip locking member shoulder 80 with tip holder shoulder 52.

If the penetrometer tubing string does not have an internal diameter large enough for receiving tip locking member 22 and tip member 20, sufficient bore space is preferably provided in the male end of adapter 4 for receiving tip locking member 22 and tip member 20 after tip locking member 22 and tip member 20 pass completely through tip retainer 14. Alternatively, an additional sample tube 6 can be added to the sample tube string and used for holding members 20 and 22. The additional sample tube 6 is positioned adjacent adapter 4. With the additional sample tube 6 thus positioned in apparatus 2, tip retainer 14 is simply positioned in the male end of the additional sample tube 6 rather than in the male end of adapter 4.

In the method of the present invention, apparatus 2 is first assembled as shown in FIGS. 1-3. In order to prevent tip locking member 22 and tip member 20 from moving downward in tip holder 8 when, prior to insertion, the assembled apparatus 2 is suspended above the ground, tape can be applied to tip member 20 and cutting member 10. Any tape applied to the exterior of apparatus 2 will be quickly removed from apparatus 2 by abrasion as apparatus 2 is driven into the ground. Alternatively, when apparatus 2 is suspended above the ground, tip locking member 22 and tip member 20 can be held in the position shown in FIG. 1 by hand. If tip locking member 22 is allowed to drop within tip holder 8 when apparatus 2 is suspended above the ground, locking keys 18 will be forced into recess 85 by frusto-conical interior surface 48. Consequently, tip locking member 22 will be "unlocked" such that tip locking member 22 and tip member 20 will not remain in the driving end portion of apparatus 2 as apparatus 2 is being driven into the ground.

Following assembly, apparatus 2 is driven into the ground to a desired subterranean location. Apparatus 2, and the cone penetrometer string to which apparatus 2 is attached, are preferably driven into the ground using a hydraulic ram.

As apparatus 2 is run into the ground, the ground resistance encountered by tip member 20 urges tip member 20 and tip locking member 22 toward the adapter end of apparatus 2. However, as discussed above, locking keys 18 positioned between rim 88 and annular lip 38 prevent tip locking member 22 from leaving tip holder 8. Consequently, tip member 20 is held substantially in the position shown in FIG. 1 as apparatus 2 is driven into the ground.

The ground resistance encountered by tip locking member 20 as apparatus 2 is driven into the ground also urges tip member 20 more tightly against tip locking member 22. The resulting compressive force substantially flattens O-ring 94 and thereby forces O-ring 94 snugly against the internal surface of cylindrical interior bore portion 50 of tip holder 8 so that O-ring 94 effectively seals passageway 12. Consequently, soil and/or water from other formations are prevented from entering sample tube(s) 6 as apparatus 2 is driven into the ground.

When apparatus 2 reaches a desired underground location, the driving operation is discontinued and the penetrometer tubing string is pulled a slight distance in the direction opposite to the direction in which said tubing string was driven into the ground. As is apparent, pulling the tubing string in the manner just described also moves the housing of apparatus 2 in the direction opposite to the direction in which apparatus 2 was driven into the ground. However, during this pulling operation, subterranean material which has compacted around tip member 20 as a result of the driving operation will hold tip member 20 and tip locking member 22 in fixed position in the underground formation until shoulder 52 of tip holder 8 abuts shoulder 80 of tip locking member 22.

During the pulling operation, as shoulder 52 of tip holder 8 approaches shoulder 80 of tip locking member 22, frusto-conical interior surface 48 of tip holder 8 contacts the outer ends of locking keys 18 and pushes the locking keys into recess 85. Consequently, this pulling operation unlocks tip locking member 22 so that tip locking member 22 and tip member 20 are thereafter allowed to move out of tip holder 8 toward adapter 4.

After the penetrometer tubing string has been pulled a sufficient distance to unlock tip locking member 22, the tubing string is driven further into the ground in order to fill sample tube(s) 6 with underground sample material. As the penetrometer tubing string drives the housing of apparatus 2 further into the ground, tip locking member 22, and tip member 20, which are now unlocked, remain in fixed position in the underground formation. Consequently, as the housing of apparatus 2 is driven deeper into the ground, tip locking member 22 and tip member 20 travel through sample holder 16, through sample tube(s) 6, through tip retainer 14, and into adapter 4. After tip locking member 22 and tip member 20 pass through tip retainer 14, the petal members of tip retainer 14 will resiliently close to prevent tip locking member 22 and tip member 20 from falling back into sample tube(s) 6 and thereby interfering with the sample collected in apparatus 2.

As apparatus 2 is driven deeper into the ground and tip member 20 is forced within passageway 12 toward adapter 4, circular cutting edge 64 cuts a sample material core from the underground formation. The sample material core travels through sample holder 16 and is received in sample tube(s) 6.

After the sample tubes 6 have been filled with sample material, apparatus 2 is pulled from the ground. As apparatus 2 is pulled from the ground, the petal members of sample holder 16 resiliently close in order to prevent unconsolidated sample material from falling out of sample tube(s) 6.

After apparatus 2 is removed from the ground, apparatus 2 is disassembled such that the subterranean sample core can be pushed out of sample tube(s) 6.

Figure 6:
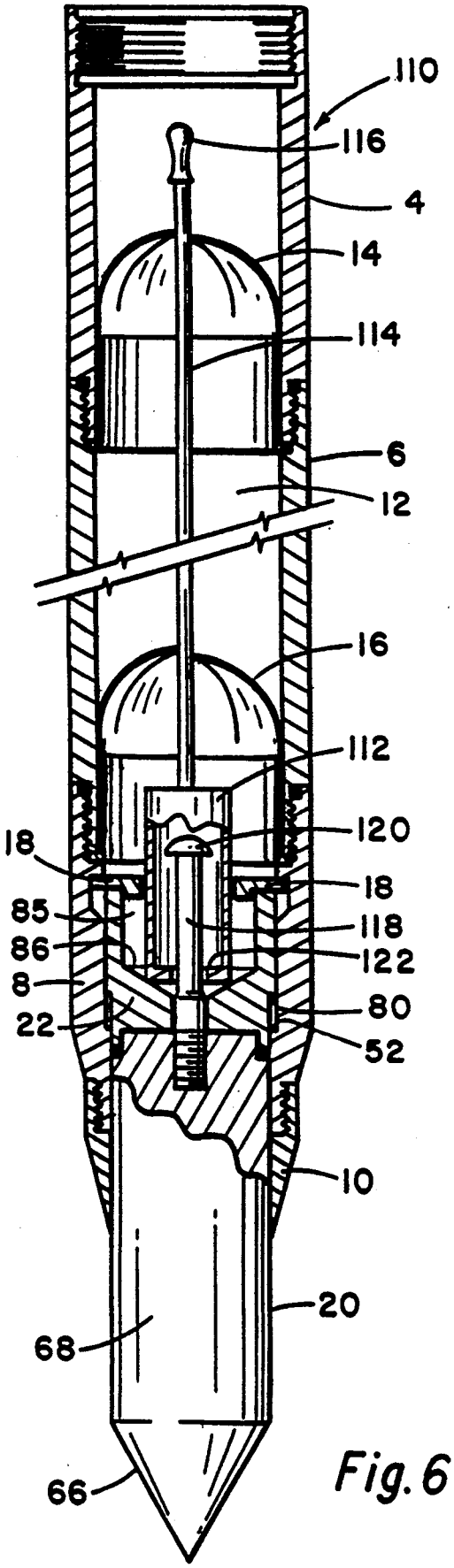
FIG. 6 provides a cutaway side view of a second embodiment of the sampling apparatus of the present invention.
Figure 5:
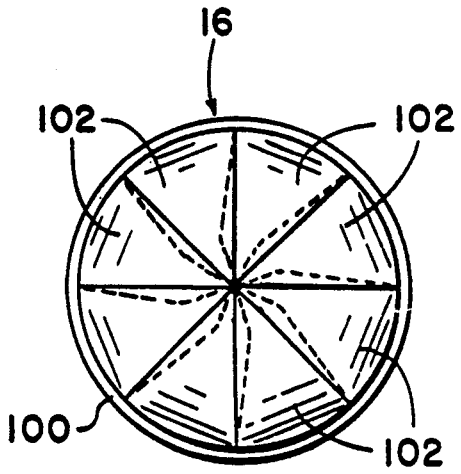
FIG. 5 provides a top view of the inventive sample holding device.
Figure 4:
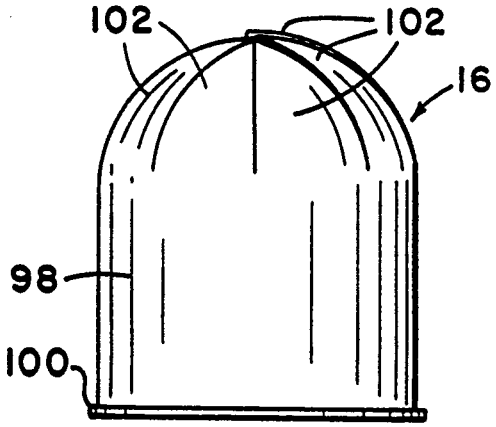
FIG. 4 provides a side view of an embodiment of the sample holding device of the present invention.

A second embodiment of the inventive apparatus 110 is depicted in FIG. 6. Apparatus 110 is particularly desirable for use when samples must be taken from unconsolidated, watery and/or mushy underground formations. The material in such formations may be too fluid to force tip locking member 22 and tip member 20 through sample tubes 6 and past tip retainer 14. If the formation material does not possess sufficient strength to force tip locking member 22 and tip member 20 through passageway 12, an adequate amount of the material cannot be collected in apparatus 2.

Apparatus 110 includes essentially all of the features of apparatus 2. However, apparatus 2 also includes a tube member 112, a rod member 114, and a cable connection 116. Further, in forming apparatus 110, the bolt 92 of apparatus 2 is replaced with a rod member 118 having external threads at one end thereof, for connecting rod member 118 to tip member 20, and a head portion 120 at the other end thereof.

As shown in FIG. 6, tube member 112 is positionable in apparatus 2 such that the lower portion of tube member 112 extends between locking keys 18 and into recess 85. The outside diameter of tube member 112 is preferably such that, when tube member 112 is positioned as shown in FIG. 6, tube member 112 will prevent locking keys 18 from falling into recess 85. Consequently, tube member 112 will prevent tip locking member 22 from unlocking when the apparatus 2 is suspended above the ground. Tube member 112 thereby eliminates the need to apply tape to tip member 20 and cutting member 10.

Tube member 112 has an inwardly extending lip 122 at the end thereof closest to tip locking member 22. Lip 122 has an inside diameter which is less than the outside diameter of the base of head portion 120 of rod member 118.

Rod member 114 is attached, by welding or by other means, to the end of tube member 112 furthest from tip locking member 22. If the apparatus 110 includes a tip retainer 14 as shown in FIG. 6, rod member 14 must be of sufficient length to extend through tip retainer 14 when shoulder 52 of tip holder 8 is abutting shoulder 80 of tip locking member 22 and tube member 112 is resting against the frusto-conical portion 86 of recess 85. Otherwise, a cable which is run down the penetrometer tubing string for connecting with cable connection 116 could be prevented by tip retainer 14 from reaching cable connection 116.

Cable connection 116 is preferably a commercial male air fitting (e.g., a Milton Kwik-Change Style A coupler) which is screwed onto, or otherwise attached to, the end of rod member 114. After apparatus 110 is driven into the ground to a desired location, a female air connection (not shown) connected to the end of a cable is lowered, or otherwise run into, the penetrometer tubing string toward apparatus 110. As will be understood by those skilled in the art, the internal spring member of the female air connection should be removed prior to inserting the female connection into the penetrometer string so that, when the female connection reaches the male connection, the internal ball members of the female connection will automatically move into the groove portion of male connection 116. Additionally, the groove portion of male connection 116 is preferably ground down sufficiently on one side so that the female connection can be removed from male connection 116 by jerking the cable.

Once assembled, apparatus 110 is driven into the ground in the same manner as apparatus 2. However, when apparatus 110 reaches a desired location in the formation, a female connection attached to the end of a cable is run into the penetrometer tubing string until said female connection reaches and connects with male connection 116. The cable is then used to pull tube member 112 away from tip locking member 22 a sufficient distance to allow locking keys 18 to fall into recess 85. With tube member 112 thus positioned, tube locking member 22 of apparatus 110 is unlocked in the same manner as described above for tube locking member 22 of apparatus 2.

After tip locking member 22 is unlocked, tube member 112 is pulled still further from tip locking member 22 until lip 122 of tube member 112 contacts the base of head portion 120 of rod member 118. The cable is then used to pull tip locking member 22 and tip member 20 through passageway 12 and into adapter 4, thus ensuring that tip locking member 22 and tip member 20 are retained by retainer 14. With the tip locking member 22 and tip member 20 thus retained at the adapter end of apparatus 110, said tip locking member and said tip member cannot interfere with the collection and retention of sample material in sample tube(s) 6.

When tip locking member 22 and tip member 20 are secured behind tip retainer 14, the female cable connection is removed from male connection 116 by jerking said cable. The female connection and cable are then pulled out of the cone penetrometer tube string.

Thus, the present invention is well adapted to carry out the objects and obtain the ends and advantages mentioned above as well as those inherent therein. While numerous changes may be made by those skilled in the art, such changes are encompassed within the scope of the invention as defined by the appended claims.

We claim:

1. An apparatus for obtaining a subterranean material sample, comprising:

an elongate housing having a passageway extending longitudinally therethrough, said housing having a first end and a second end and said passageway having a first portion and a second portion, said first portion being closer than said second portion to said first end;

a tip member positionable in the second portion of said passageway such that said tip member protrudes from the second end of said housing, said tip member being movable in said passageway from said second portion to said first portion; and at least one locking key for releasably preventing said tip member from moving from said second portion of said passageway to said first portion of said passageway;

said locking key securing a tip locking member positionable inside said passageway and having a first end and a second end, said second end of said tip locking member being positionable on a first end of said tip member and said first end of said tip locking member having a recess therein for receiving said key when said locking means is unlocked; and an O-ring seal positionable between said second end of said tip locking member and said first end of said tip member.

2. An apparatus as described in claim 1 wherein said O-ring seals said passageway when said tip member is positioned under pressure against said tip locking member in said second portion of said passageway.

3. An apparatus as described in claim 1 wherein said locking means can be unlocked when said apparatus is inserted into the ground by moving said housing in a direction opposite to the direction in which said apparatus is inserted into the ground.

4. An apparatus as described in claim 1 further comprising means, positionable in said passageway directly contacting said locking key, for preventing said locking key from unlocking when said apparatus is suspended aboveground said means being suitable for pulling said tip member from said second portion of said passageway to said first portion of said passageway.

5. An apparatus as described in claim 1 further comprising means for preventing said tip member from falling out of said second end of said housing.

6. An apparatus as described in claim 1 wherein said tip locking member, when positioned on said first end of said tip member, is movable with said tip member from said second portion of said passageway to said first portion of said passageway.

7. An apparatus as described in claim 1 wherein said recess defines a rim on said first end of said tip locking member, said key being positionable on said rim for locking said locking means.

8. An apparatus as described in claim 7 wherein said locking means further comprises a lip extending into said passageway from said housing, said key being positionable between said lip and said rim for locking said locking means.

9. An apparatus as described in claim 1 further comprising a pushing means for pushing said key into said recess.

10. An apparatus as described in claim 9 wherein said pushing means is operable for pushing said key into said recess when said apparatus is inserted into the ground by moving said housing in a direction opposite to the direction in which said apparatus is inserted into the ground.

11. An apparatus as described in claim 1 further comprising means for connecting said first end of said apparatus to the end of a tubing string.

12. An apparatus as described in claim 1 further comprising a sample holding means for holding sample material in said passageway.

13. An apparatus as described in claim 12 wherein said sample holding means comprises at least one resilient member which will open to allow said tip member and said sample material to pass therethrough toward said first end of said housing and which will resiliently close to prevent said tip member and said sample material from passing therethrough toward said second end of said housing.

14. An apparatus as described in claim 13 further comprising holding means for holding said sample holding means in said housing.

15. An apparatus as described in claim 14 wherein said holding means comprises a rim positionable between two sections of said housing.

16. An apparatus as described in claim 13 wherein said sample holding means comprises a plurality of said resilient members.

17. An apparatus as described in claim 1 further comprising a tip retaining means for preventing said tip member from moving from said first portion of said passageway toward said second portion of said passageway.

18. An apparatus as described in claim 17 wherein said tip retaining means comprises at least one resilient member which will open to allow said tip member to pass therethrough toward said first end of said housing and which will resiliently close to prevent said tip member from passing therethrough toward said second end of said housing.

19. A method of obtaining a subterranean material sample, utilizing a sampling apparatus, comprising an elongate housing having a passageway extending longitudinally therethrough, said housing having a first end and a second end and said passageway having a first portion and a second portion, said first portion being closer than said second portion to said first end; and a tip member positionable in the second portion of said passageway such that said tip member protrudes from the second end of said housing, said tip member being movable in said passageway from said second portion to said first portion; and locking means for releasably preventing said tip member from moving from said second portion of said passageway to said first portion of said passageway said locking means being capable of being unlocked when said sampling apparatus is inserted into the ground by moving said housing in a direction opposite to the direction in which said sampling apparatus is inserted in the ground and said locking means has at least one locking key, a tip locking member positioned inside said passageway having a first end and a second end, said second end of said tip locking member being positioned on a first end of said tip member, said first end of said tip locking member having a recess therein for receiving said key when said locking means is unlocked, and said recess defining a rim on said first end of said tip locking member said key being positioned on said rim when said locking means is locked, comprising the steps of:

inserting said sampling apparatus into the ground; and unlocking said locking means to permit said tip member to move from said second portion of said passageway to said first portion of said passageway by moving said housing in said direction opposite to the direction in which said sampling apparatus in inserted into the ground partially filling said passageway with sample material further inserting said sampling apparatus into the ground in order to insure at least partial filling of said passageway with sample material.

20. A method as described in claim 19 wherein said sampling apparatus further comprises an O-ring, associatable with said tip member, for sealing said passageway when said tip member is positioned under pressure against said tip locking member in said second portion of said passageway.

21. A method as described in claim 19 further comprising the step, following said step of unlocking said locking means, of pulling said tip member from said second portion to said first portion of said passageway.

22. A method as described in claim 19 wherein said sampling apparatus further comprises a pushing means for pushing said key into said recess when, in accordance with said step of unlocking, said housing is moved in said direction opposite to the direction in which said sampling apparatus is inserted into the ground.

23. A method as described in claim 22 wherein said locking means further comprises a lip extending into said passageway from said housing, said key being positioned between said lip and said rim when said locking means is locked.

24. A method as described in claim 19 wherein said tip locking member is movable with said tip member from said second portion of said passageway to said first portion of said passageway.

25. A method as described in claim 19 wherein said sampling apparatus further comprises an O-ring positioned between said tip member and said tip locking member for sealing said passageway when said tip member is positioned in said second portion of said passageway.

26. A method as described in claim 19 wherein said sampling apparatus is connected to the end of a tubing string and said sampling apparatus is inserted into the ground in accordance with said step of inserting by driving said tubing string into the ground.

27. A method as described in claim 26 wherein said tubing string is driven into the ground using a hydraulic ram.

* * * * *